US005803266A

United States Patent [19]

Blackwelder

[11] Patent Number: 5,803,266

[45] Date of Patent: Sep. 8, 1998

[54] ACCESSORIES KIT HAVING INTERCHANGEABLE ORNAMENTS

[75] Inventor: Natalie A. Blackwelder, Charleston, W. Va.

[73] Assignee: Hats By Annie, Inc., Charleston, W. Va.

[21] Appl. No.: 761,307

[22] Filed: Dec. 6, 1996

[51] Int. Cl.[6] ..... B65D 73/00; A42B 1/24

[52] U.S. Cl. ..... 206/575; 206/8; 206/458; 2/209.13; 2/244; 2/918

[58] Field of Search ..... 206/575, 457, 206/458, 231, 278, 8, 460, 805, 813; 2/115, 195.1, 209.13, 244, 918; 383/75

[56] References Cited

U.S. PATENT DOCUMENTS

| | | | |
|---|---|---|---|
| 2,006,463 | 7/1935 | Landis . | |
| 2,302,560 | 11/1942 | Latona . | |
| 2,479,269 | 8/1949 | Schneider | 206/8 |
| 4,611,355 | 9/1986 | Galanto . | |
| 4,776,043 | 10/1988 | Coleman | 2/195.1 |
| 4,911,287 | 3/1990 | Speers | 206/575 |
| 4,975,987 | 12/1990 | Teachout et al. | 2/244 |
| 4,995,525 | 2/1991 | Kehrer | 206/805 |
| 5,070,545 | 12/1991 | Tapia . | |
| 5,090,559 | 2/1992 | Gendreau | 383/75 |
| 5,136,726 | 8/1992 | Kellin et al. | 2/155 |
| 5,249,802 | 10/1993 | McCarthy | 206/457 |
| 5,253,368 | 10/1993 | Blake . | |
| 5,348,510 | 9/1994 | Dupont . | |
| 5,359,733 | 11/1994 | Brannon et al. | 2/195.1 |
| 5,359,734 | 11/1994 | Rathburn . | |
| 5,373,586 | 12/1994 | Brosnan . | |
| 5,509,144 | 4/1996 | Soergel et al. | 2/195.1 |
| 5,529,395 | 6/1996 | French | 383/75 |
| 5,533,558 | 7/1996 | Carey . | |
| 5,579,540 | 12/1996 | Walker | 383/75 |

*Primary Examiner*—Paul T. Sewell
*Assistant Examiner*—Luan K. Bui
*Attorney, Agent, or Firm*—Dougherty & Dremann

[57] ABSTRACT

An accessories kit for allowing a user to coordinate a clothing accessory with a variety of outfits without the expense of purchasing a separate clothing accessory for each outfit. The accessories kit includes a clothing accessory and a plurality of decorative, interchangeable ornaments for attachment to the clothing accessory. At least one of the ornaments is secured to the exterior surface of the clothing accessory by a VELCRO® fastener. The accessories kit further includes a storage container for conveniently organizing the clothing accessory and the plurality of ornaments therein. The ornaments are secured to the bottom surface of the storage container by a corresponding plurality of VELCRO® fasteners. The clothing accessory is secured to the bottom surface of the storage container, or to the opposed sides of the storage container by an elastic string.

2 Claims, 3 Drawing Sheets

ACCESSORIES KIT HAVING INTERCHANGEABLE ORNAMENTS

RELATED APPLICATIONS

This application claims the benefit of U.S. Provisional application No. 60/008,355 filed Dec. 7, 1995.

FIELD OF THE INVENTION

The present invention relates to an apparatus and method for accessorizing an outfit. More particularly, the invention relates to an accessories kit which allows a user to wear or carry a single clothing accessory, such as a hat, pocketbook or item of clothing, with a variety of outfits by changing the overall physical appearance of the clothing accessory with a plurality of decorative, interchangeable ornaments.

BACKGROUND OF THE INVENTION

Currently, if one wishes to coordinate a clothing accessory, such as a hat, pocketbook or item of clothing, with a particular outfit it is often necessary to purchase a new clothing accessory. Thus, accessorizing an entire wardrobe can be quite expensive, particularly when dealing with children who change sizes frequently as they grow. In addition, creating an outfit for a special occasion, such as the Fourth of July, Halloween or Christmas, generally requires one to purchase a separate outfit and/or clothing accessory for each occasion.

U.S. Pat. No. 5,373,586 to Brosnan discloses a sports cap provided with an interchangeable panel having a tradename or logo printed thereon. The sports cap permits a single cap to be utilized with a different tradename or logo for different occasions as desired by the user. However, the replaceable panels are substantially two dimensional, and the tradename or logo printed thereon is limited to the tradenames and logos of the user's favorite sports teams.

U.S. Pat. No. 5,253,368 to Blake discloses a sports cap having an erasable writing surface affixed to the crown portion of the cap. A writing implement is provided for permitting the user to inscribe a desired expression or design on the writing surface. However, the writing surface is substantially planer and does not permit the user to accessorize the cap with a specially designed, decorative ornament.

U.S. Pat. No. 2,006,463 to Landis discloses an ornamental accessory for a handbag or pocketbook. The accessory includes an exterior portion which is in the form of a removable colored member which may be replaced by another differently colored member, so that the pocketbook may be carried with differently colored outfits. The accessory, however, merely changes the exterior color of the pocketbook, and does not provide a decorative, three dimensional ornament which may be used to celebrate a special occasion.

U.S. Pat. No. 5,533,558 to Carey et al. discloses a purse provided with an interchangeable decorative covering and a means for securing the covering to the front or rear panel of the purse so that the appearance of the purse may be changed at will. The decorative covering is a one piece, thin, flexible sheet sized to cover the entire panel. The covering, however, is substantially planar and is not provided in conjunction with a storage container for conveniently organizing the purse and a plurality of coverings.

U.S. Pat. No. 5,348,510 to DuPont et al. discloses a toy hat, mask or hand puppet on which a plurality of three dimensional elements may be positioned. The hat, mask or puppet includes an exterior surface consisting of the "hook" portion of a VELCRO® fastener. The three dimensional elements include distinct facial features, such as a nose, eyes, ears, cheeks and mouth having the "loop" portion of the VELCRO® fastener secured thereto. The elements can be positioned on the exterior surface of the hat, mask, or puppet to create different fanciful animal, human or monster faces. The elements, however, are not suitable for decorating the hat, mask or puppet to accessorize a variety of outfits.

The known clothing accessories do not sufficiently address the problems associated with accessorizing a variety of outfits. It is apparent that there is a need for an accessories kit which allows a user to wear or carry a single clothing accessory, such as a hat, pocketbook or item of clothing, with a variety of outfits by changing the overall physical appearance of the clothing accessory with a plurality of decorative, interchangeable ornaments.

The invention allows a single clothing accessory to be used with a number of different outfits. In this manner it is possible to accessorize an entire wardrobe with a single hat, pocketbook or item of clothing. In a particular embodiment, the invention allows a user to accessorize an outfit for a special occasion, such as the Fourth of July, Halloween, or Christmas. Accordingly, the accessories kit of the invention is cost effective because it provides the user with as many "looks" as the number of decorative, interchangeable ornaments that are included in the accessories kit, or are purchased separately, without the expense of purchasing a new clothing accessory.

OBJECTS OF THE INVENTION

In view of the deficiencies of the known accessories, the principal object of the invention is to provide an apparatus and a method for changing the physical appearance of a clothing accessory, such as a hat, pocketbook or item of clothing, without the expense of buying a new accessory.

A further, and more particular, object of the invention is to provide an accessories kit that includes a plurality of decorative, interchangeable ornaments for changing the physical appearance of a clothing accessory.

Another object of the invention is to provide an accessories kit that includes a clothing accessory and a plurality of decorative, interchangeable ornaments secured in a storage container for conveniently organizing the clothing accessory and ornaments.

SUMMARY OF THE INVENTION

The invention is an accessories kit for allowing a user to wear or carry a single clothing accessory with a variety of outfits. The accessories kit includes a clothing accessory having an exterior surface, and a plurality of decorative, interchangeable ornaments. The clothing accessory is preferably selected from the group consisting of a hat, a pocketbook, a scarf, a belt, a shirt, a skirt, a pair of pants, a sock and a shoe. The plurality of ornaments are various trimming-type decorations, and are preferably selected from the group consisting of bows, buttons, flowers and colored fabrics. Each of the plurality of ornaments is designed to coordinate with, i.e., to be aesthetically pleasing with, a variety of outfits so that the clothing accessory may be used in conjunction with a number of different outfits.

First fastening means are provided for securing at least one of the ornaments to the exterior surface of the clothing accessory. Preferably, the first fastening means consists of the hook portion of VELCRO® material affixed to the exterior surface of the clothing accessory or to the backside of the plurality of ornaments, and the loop portion of VELCRO® material affixed to the other of the exterior surface of the clothing accessory and the backside of the plurality of ornaments.

The accessories kit further includes a storage container having a bottom surface which is provided with second fastening means for securing each of the plurality of ornaments to the bottom surface of the storage container. Preferably, the second fastening means consists of the hook portion of VELCRO® material affixed to the backside of the plurality of ornaments or to the bottom surface of the storage container, and the loop portion of VELCRO® material affixed to the other of the backside of the plurality of ornaments and the bottom surface of the storage container.

The storage container further includes retaining means for retaining the clothing accessory within the storage container. Preferably, the storage container includes a pair of opposed sides and the retaining means consists of an elastic string having a first end and a second end. The first end and the second end of the elastic string can be secured to the bottom surface of the storage container, or to the opposed sides of the storage container.

Accordingly, the accessories kit of the invention provides a clothing accessory, such as a hat, pocketbook or item of clothing, with a plurality of decorative, interchangeable, three dimensional ornaments so that the clothing accessory may be used with a variety of outfits. The clothing accessory is capable of changing its overall physical appearance with the interchangeable ornaments so as to coordinate with a number of different outfits. In addition, the kit includes a storage container for conveniently organizing the clothing accessory and the plurality of ornaments therein.

BRIEF DESCRIPTION OF THE DRAWINGS

The foregoing and other objects will become more readily apparent by referring to the following detailed description and the appended drawings in which.

DETAILED DESCRIPTION

The invention is an accessories kit 10 for allowing a user to wear or carry a single clothing accessory 20 with a variety of outfits. The accessories kit 10 comprises a clothing accessory 20, such as a hat, pocketbook or item of clothing, and a plurality of decorative, interchangeable ornaments 30 for attachment to the clothing accessory. The clothing accessory 20 is preferably selected from the group consisting of a hat, a pocketbook, a scarf, a belt, a shirt, a skirt, a pair of pants, a sock and a shoe. The plurality of ornaments 30 are various trimming-type decorations, and are preferably selected from the group consisting of bows, buttons, flowers, colored fabrics and personalized novelties such as decorations including personalized initials. Each of the plurality of ornaments 30 is designed to coordinate with, i.e., to be aesthetically pleasing with, a variety of outfits so that the clothing accessory 20 may be used in conjunction with a number of different outfits.

Figure 1:
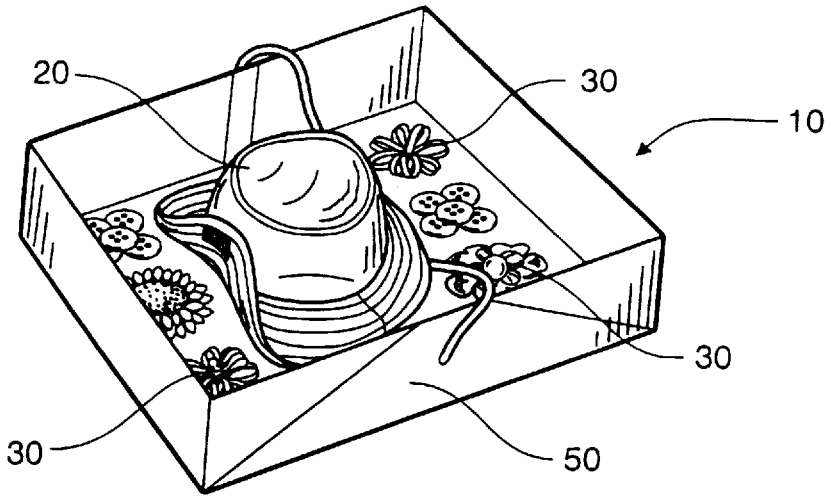
FIG. 1 is an isometric view of a preferred embodiment of an accessories kit according to the invention.

In the embodiment illustrated in FIG. 1, the clothing accessory 20 is a floppy hat and the plurality of ornaments 30 are an assortment of six preselected buttons, bows, ribbons and flowers. The clothing accessory 20 may be any clothing accessory, but most preferably is a hat or pocketbook. The plurality of ornaments 30 may be any combination of decorative items of different colors. Preferably, however, the plurality of ornaments 30 are an assortment of three dimensional, specially designed ornaments which are selected to coordinate with a variety of outfits of different colors. Thus, a user can avoid the expense of purchasing a different clothing accessory for each outfit in his or her wardrobe.

Figure 3:
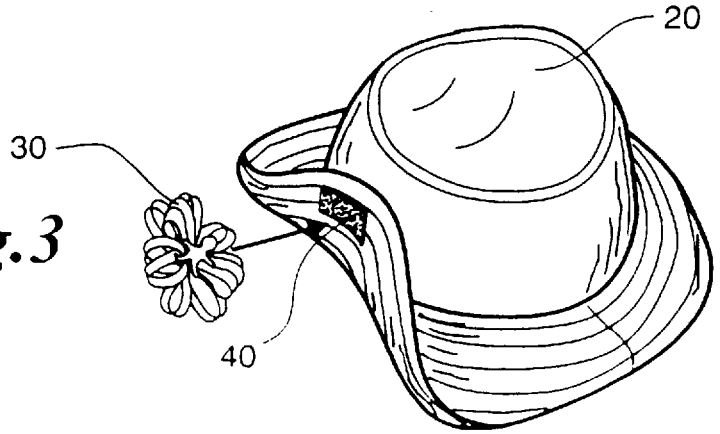
FIG. 3 is an isometric view of a preferred embodiment of the invention illustrating a hat and one of the plurality of decorative, interchangeable ornaments of FIG. 1.

As best shown in FIG. 3, first fastening means 40 are provided for securing at least one of the ornaments 30 to the exterior surface of the clothing accessory 20. The first fastening means 40 may be any means for attaching the ornament 30 to the clothing accessory 20, such as snaps, buttons, hooks, etc. Preferably, the first fastening means 40 comprises the hook portion of VELCRO® material affixed to the exterior surface of the clothing accessory 20 or to the backside of each of the plurality of ornaments 30 (not shown), and the corresponding loop portion of VELCRO® material affixed to the other of the exterior surface of the clothing accessory and the backside of each of the plurality of ornaments.

Figure 2:
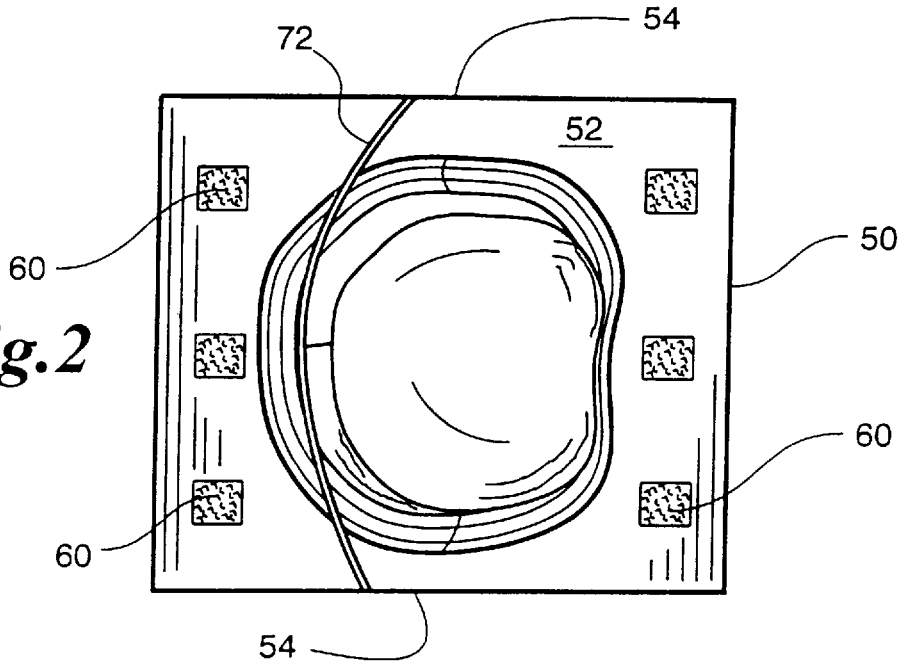
FIG. 2 is a top view of the accessories kit of FIG. 1 with the decorative ornaments removed from the storage container.

The accessories kit 10 further comprises a storage container 50 having a bottom surface 52 which is provided with second fastening means 60 (FIG. 2) for securing each of the plurality of preselected ornaments 30 to the bottom surface of the storage container. The second fastening means 60 may be any means for attaching the ornaments 30 to the bottom surface 52 of the storage container 50, such as snaps, buttons, hooks, etc. Preferably, the second. fastening means 60 comprises the hook portion of VELCRO® material affixed to the backside of each of the plurality of ornaments 30 or to the bottom surface 52 of the storage container 50, and the corresponding loop portion of VELCRO® material affixed to the other of the backside of each of the plurality of ornaments and the bottom surface of the storage container.

In a preferred embodiment, the storage container 50 further comprises retaining means 70 (FIG. 2) for retaining the clothing accessory 20 within the storage container. Preferably, the storage container comprises a pair of opposed sides 54 and the retaining means 70 comprises an elastic string 72 having a first end and a second end. The first end and the second end of the elastic string 72 can be secured to the bottom surface 52 of the storage container 50, or to the opposed sides 54 of the storage container.

Figure 4:
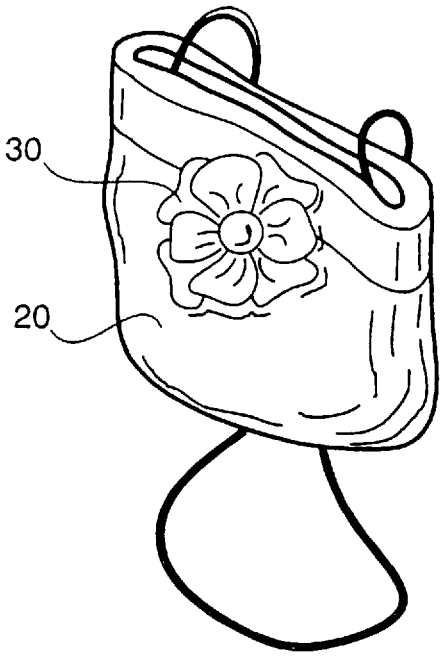
FIG. 4 is an isometric view of another preferred embodiment of the invention illustrating a purse and one of the plurality of decorative, interchangeable ornaments of FIG. 1.
Figure 5:
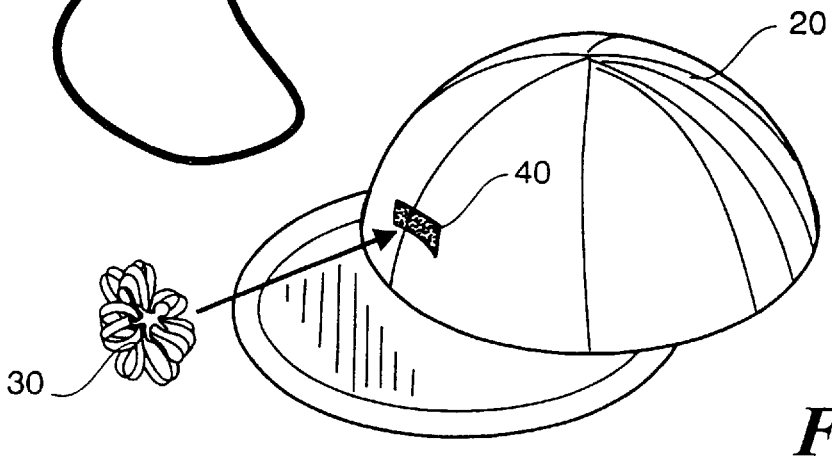
FIG. 5 is an isometric view of another preferred embodiment of the invention illustrating a hat and one of the plurality of decorative, interchangeable ornaments of FIG. 1.
Figure 6:
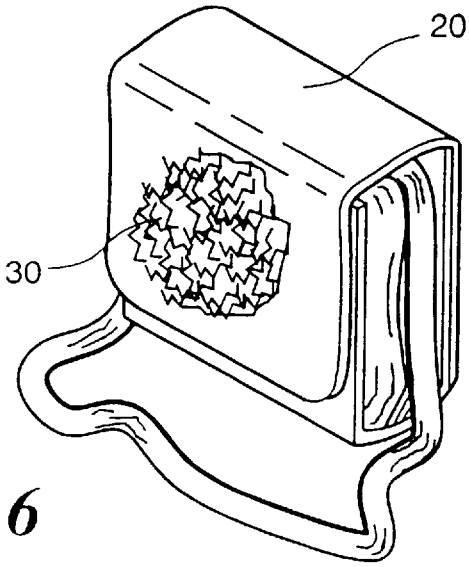
FIG. 6 is an isometric view of another preferred embodiment of the invention illustrating a purse and a decorative, interchangeable ornament which is purchased separately.

FIG. 4 illustrates another preferred embodiment of the accessories kit 10 wherein the clothing accessory 20 is a purse having one of the plurality of decorative, interchangeable ornaments 30 attached thereto. FIG. 5 illustrates another preferred embodiment of the accessories kit 10 wherein the clothing accessory 20 is a "baseball cap" style hat having one of the plurality of decorative, interchangeable ornaments 30 for attachment thereto. FIG. 6 illustrates yet another preferred embodiment of the accessories kit 10 wherein the clothing accessory 20 is a "handbag" style purse having a decorative, interchangeable ornament 30 attached thereto which is purchased separately from the kit.

Accordingly, the accessories kit 10 of the invention provides a clothing accessory 20, such as a hat, pocketbook or item of clothing, with a plurality of decorative, interchangeable, three dimensional ornaments so that the clothing accessory may be used with a variety of outfits. The clothing accessory 20 is capable of changing the overall physical appearance of an outfit with the interchangeable ornaments so as to coordinate the clothing accessory with a number of different outfits. In addition, the kit 10 includes a storage container 50 for conveniently organizing the clothing accessory 20 and the plurality of ornaments 30 therein.

ALTERNATIVE EMBODIMENTS

Figure 7:
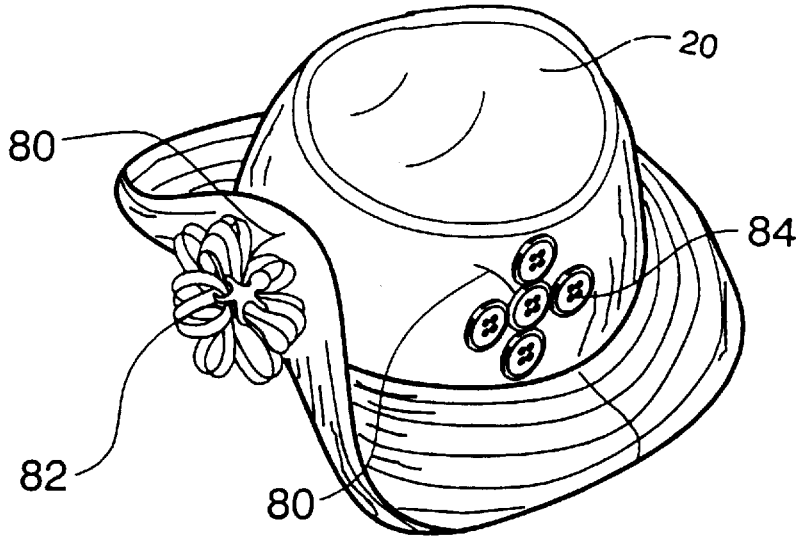
FIG. 7 is a perspective view of an alternative embodiment of the accessories kit according to the invention.

FIG. 7 illustrates an alternative embodiment of an accessories kit 10 according to the invention. As shown, a clothing accessory 20, for example a hat, is provided with a plurality of interchangeable ornaments 82 and 84 attached thereto in a conventional manner. The ornaments 82 and 84 may be attached to the hat 20 in any suitable manner. However, preferably, the ornaments 82 and 84 are attached to the hat 20 with plastic attaching strands 80. This alternative embodiment of the invention provides the commercial advantage that a greater number of accessories kits 10 may be packaged together for cost effective shipment from the manufacturer to the distributor or retailer.

Figure 8:
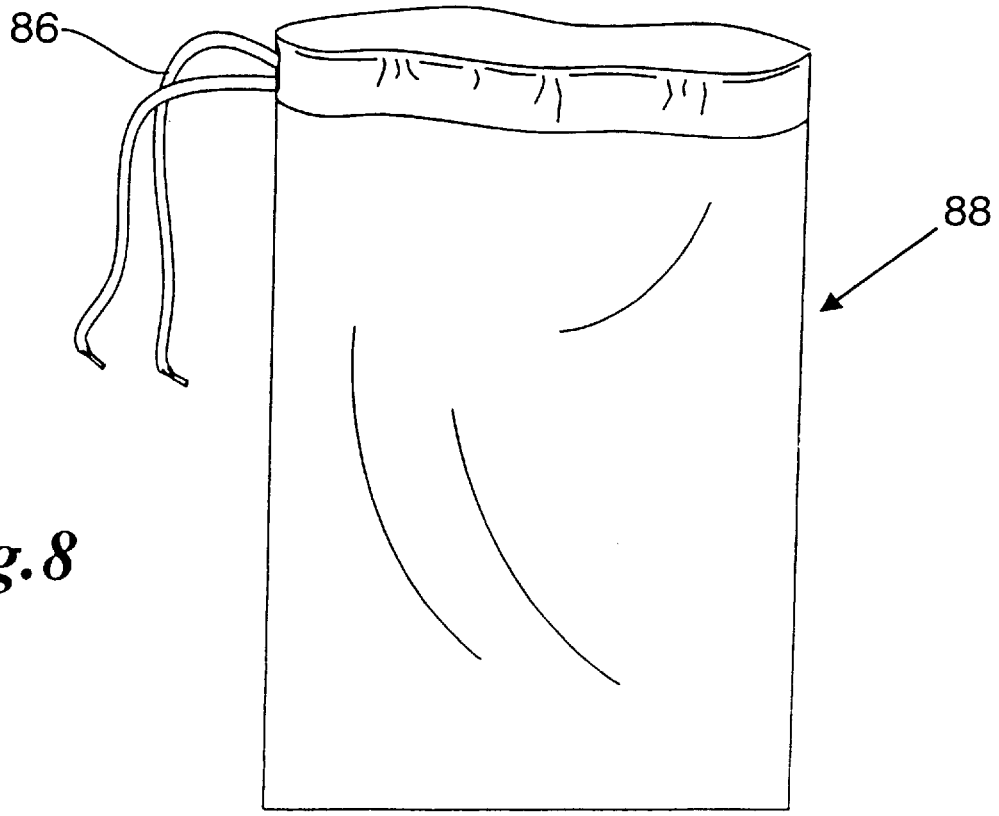
FIG. 8 is a elevation view of an alternative embodiment of a storage container according to the invention.

FIG. 8 illustrates an alternative embodiment of a storage container 50 according to the invention. As shown, the storage container 50 may be a bag 88 made from plastic or fabric, such as denim, for containing the clothing accessory 20 and the plurality of interchangeable ornaments 30. Preferably, the bag 88 is made from the same material as the clothing accessory 20 so that the overall aesthetic appearance of the accessories kit 10 is enhanced. The bag 88 may comprise a drawstring 86 to prevent the interchangeable ornaments 30 from becoming lost or separated when not in use.

SUMMARY OF THE ACHIEVEMENT OF THE OBJECTS OF THE INVENTION

From the foregoing, it is readily apparent that the invention provides an apparatus and a method for coordinating a clothing accessory with an outfit without the expense of purchasing a separate clothing accessory for each outfit in a user's wardrobe. The apparatus of the invention is an accessories kit which includes a clothing accessory, such as a hat, pocketbook or item of clothing, and a plurality of decorative, interchangeable ornaments which can be used to accessorize a variety of outfits. The accessories kit further includes a storage container for conveniently organizing the clothing accessory and the plurality of ornaments therein. Accordingly, the accessories kit described herein is cost effective and provides the user with as many "looks" as the number of ornaments that are included with the kit, or that are purchased separately. The accessories kit also allows one to accessorize an outfit for a special occasion such as the Fourth of July, Halloween or Christmas.

It is to be understood that the foregoing description and specific embodiments are merely illustrative of the best mode of the invention and the principles thereof, and that various modifications and additions may be made to the apparatus and to the method of using the apparatus by those skilled in the art, without departing from the spirit and scope of the invention.

That which is claimed is:

1. An accessories kit for allowing a user to wear or carry a clothing accessory with a variety of different outfits, said kit comprising a clothing accessory having an exterior surface;

a plurality of decorative, interchangeable ornaments selected from the group consisting of bows, buttons, ribbons and flowers, each of said ornaments selected to coordinate said clothing accessory with at least one of the variety of different outfits;

first fastening means comprising a hook material affixed to one of said clothing accessory and said plurality of ornaments; and a loop material affixed to the other of said clothing accessory and said plurality of ornaments; and a storage container comprising a bottom surface;

a plurality of second fastening means comprising a hook material affixed to one of said plurality of ornaments and said bottom of said storage container and a loop material affixed to the other of said plurality of ornaments and said bottom of said storage container; and a retaining means comprising an elastic string having a first end and a second end, said first end and said second end of said elastic string affixed to said bottom surface of said storage container;

wherein said first fastening means secures at least one of said Plurality of ornaments to the exterior surface of said clothing accessory;

wherein said plurality of second fastening means of said storage container secure said plurality of ornaments to said bottom surface of said storage container; and wherein said retaining means of said storage container retains said clothing accessory within said storage container.

2. An accessories kit according to claim 1 wherein said clothing accessory is selected from the group consisting of a hat, a baseball cap style hat, a purse and a handbag style purse.

* * * * *